US011242633B2

(12) United States Patent
Dedow et al.

(10) Patent No.: US 11,242,633 B2
(45) Date of Patent: Feb. 8, 2022

(54) WASHING MACHINE APPLIANCES AND METHODS OF OPERATION

(71) Applicant: Haier US Appliance Solutions, Inc., Wilmington, DE (US)

(72) Inventors: Gregory Allen Dedow, Louisville, KY (US); Martin Ortega Brena, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 146 days.

(21) Appl. No.: 16/591,952

(22) Filed: Oct. 3, 2019

(65) Prior Publication Data

US 2021/0102325 A1 Apr. 8, 2021

(51) Int. Cl.

| | |
|---|---|
| ***D06F 33/02*** | (2006.01) |
| ***D06F 33/00*** | (2020.01) |
| ***D06F 34/18*** | (2020.01) |

(52) U.S. Cl.

CPC ..... *D06F 33/00* (2013.01); *D06F 34/18* (2020.02)

(58) Field of Classification Search

CPC ..... D06F 33/00; D06F 34/18
USPC ..... 8/159
See application file for complete search history.

(56) References Cited

U.S. PATENT DOCUMENTS

| | | | | |
|---|---|---|---|---|
| 5,671,494 | A | 9/1997 | Civanelli et al. | |
| 6,578,225 | B2 | 6/2003 | Jonsson | |
| 7,530,133 | B2 | 5/2009 | Mitts | |
| 8,679,198 | B2 | 3/2014 | Bae et al. | |
| 8,726,440 | B2 | 5/2014 | Bolduan et al. | |
| 8,938,835 | B2 | 1/2015 | Bae et al. | |
| 9,279,206 | B2 | 3/2016 | Ashrafzadeh et al. | |
| 10,214,844 | B2 | 2/2019 | Davis | |
| 2006/0185095 | A1* | 8/2006 | Mitts | D06F 35/007 8/158 |

FOREIGN PATENT DOCUMENTS

| | | | |
|---|---|---|---|
| EP | 1995366 | A1 | 11/2008 |
| WO | WO2018076082 | A1 | 5/2018 |

* cited by examiner

*Primary Examiner* — Tinsae B Ayalew
(74) *Attorney, Agent, or Firm* — Dority & Manning, P.A.

(57) ABSTRACT

A washing machine appliance, including one or more methods of operation, is provided herein. A method of operation may include rotating articles within a tub at a tumble speed for a first period and rotating articles within the tub at a pre-plaster speed for a second period following the first period. The pre-plaster speed may be greater than the tumble speed. The method may also include measuring movement of the tub during the second period. The method may further include determining whether a set condition is met based on the measured movement, and rotating articles within the tub at a plaster speed in response to determining the set condition is met based on the measured movement.

18 Claims, 8 Drawing Sheets

WASHING MACHINE APPLIANCES AND METHODS OF OPERATION

FIELD OF THE INVENTION

The present subject matter relates generally to washing machine appliances, such as horizontal axis washing machine appliances, and methods for monitoring load balances in such washing machine appliances.

BACKGROUND OF THE INVENTION

Washing machine appliances generally include a wash tub for containing water or wash fluid (e.g., water and detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc. Washing machine appliances include vertical axis washing machine appliances and horizontal axis washing machine appliances, where "vertical axis" and "horizontal axis" refer to the axis of rotation of the wash basket within the wash tub.

A significant concern during operation of washing machine appliances is the balance of the tub during operation. For example, articles and water loaded within a basket may not be equally weighted about a central axis of the basket and tub. Accordingly, when the basket rotates, in particular during a spin cycle, the imbalance in clothing weight may cause the basket to be out-of-balance within the tub, such that the axis of rotation does not align with the cylindrical axis of the basket or tub. Such out-of-balance issues can cause the basket to contact the tub during rotation, and can further cause movement of the tub within the cabinet. Significant movement of the tub can, in turn, cause excessive noise, vibration or motion, or damage to the appliance.

Various methods are known for monitoring load balances and preventing out-of-balance scenarios within washing machine appliances. Such monitoring and prevention may be especially important, for instance, during the high-speed rotation of a plaster phase of a spin cycle that ensures water is shed from articles within the tub. Typical systems guess when articles within the tub are in a suitable position for the plaster phase based on monitored motor current or rotational velocity. One or more balancing rings may be attached to the rotating basket to provide a rotating annular mass that minimizes the effects of imbalances. However, such systems may fail to accurately determine the position of articles within the tub or basket. Moreover, in the case of balancing rings, such systems may increase the amount of energy or torque required to rotate the basket, thereby decreasing efficiency.

Accordingly, improved methods and apparatuses for monitoring load balance in washing machine appliances are desired. In particular, methods and apparatuses that provide for accurate detection of a balanced state or compensation for an imbalanced state during a washing operation would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a washing machine appliance is provided. The washing machine appliance has a tub. The method includes rotating articles within the tub at a tumble speed for a first period and rotating articles within the tub at a pre-plaster speed for a second period following the first period. The pre-plaster speed is greater than the tumble speed. The method also includes measuring movement of the tub during the second period. The method further includes determining a first out-of-balance value of the tub based on a first measured movement, determining a second out-of-balance value of the tub based on a second measured movement after the first measured movement, and determining a relative out-of-balance value of the tub based on the first out-of-balance value and the second out-of-balance value. The method then includes determining whether the relative out-of-balance value is less than a first threshold and whether the second out-of-balance value is less than a second threshold. When the relative out-of-balance value is less than the first threshold and the second out-of-balance value is less than the second threshold, the method includes rotating articles within the tub at a plaster speed greater than the pre-plaster speed in response to such determination.

In another exemplary aspect of the present disclosure, a method of operating a washing machine appliance is provided. The washing machine appliance defines a mutually-orthogonal vertical direction, transverse direction, and lateral direction. The washing machine appliance has a tub within which an axis of rotation is defined. The method includes rotating articles within the tub at a tumble speed for a first period and rotating articles within the tub at a pre-plaster speed for a second period following the first period. The pre-plaster speed is greater than the tumble speed. The method also includes measuring movement of the tub along the lateral direction during the second period. The lateral direction is perpendicular to the axis of rotation. The method also includes determining a plurality of out-of-balance values of the tub based on the measured movement. The plurality of out-of-balance values include a current out-of-balance value and a previous out-of-balance value. The method further includes determining a relative out-of-balance value of the tub based on the plurality of out-of-balance values. The method then includes determining whether the relative out-of-balance value is less than a first threshold and whether the current out-of-balance value is less than a second threshold. When the relative out-of-balance value is less than the first threshold and the current out-of-balance value is less than the second threshold, the method includes rotating articles within the tub at a plaster speed greater than the pre-plaster speed in response to such determination.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
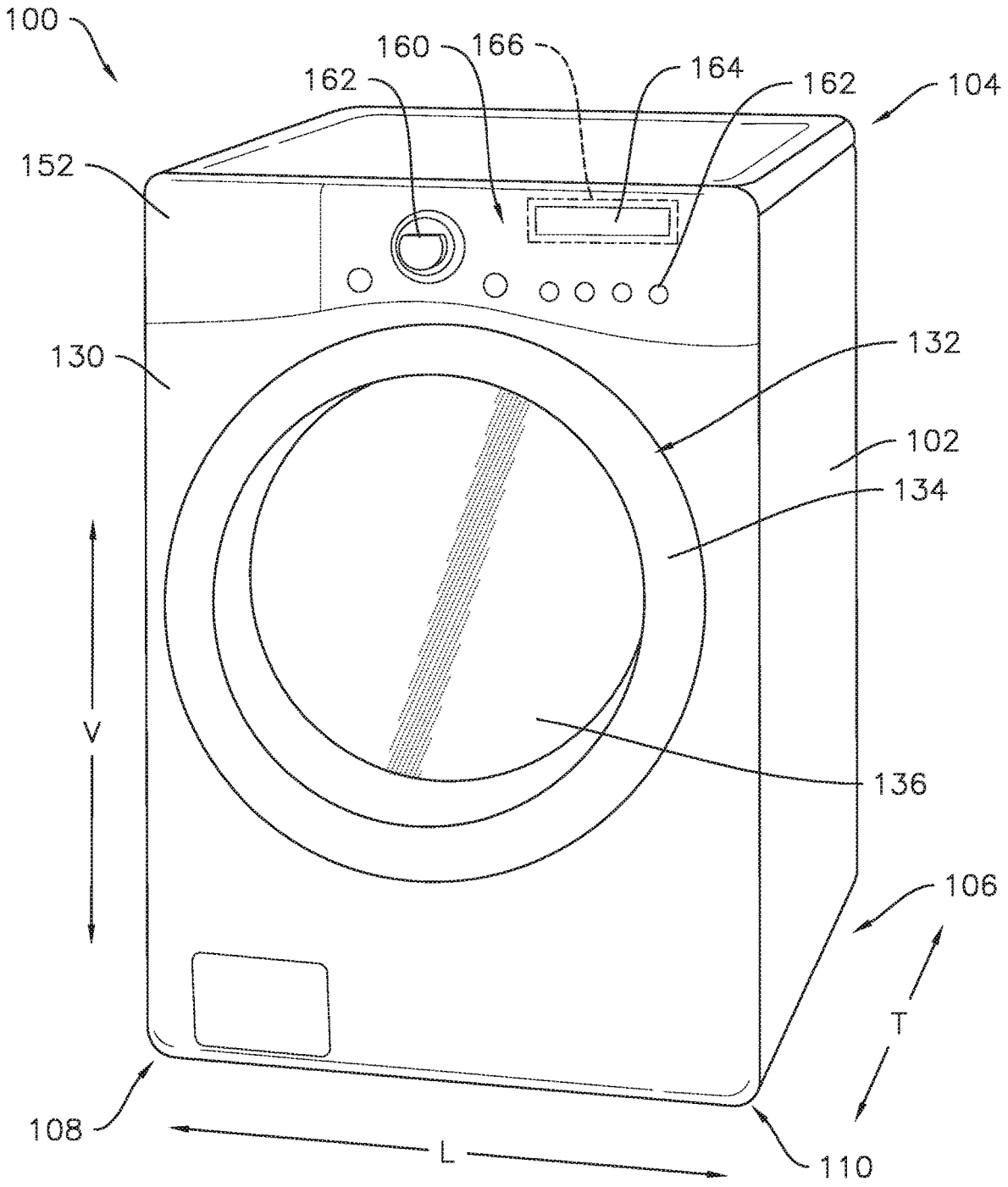
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements.

Figure 2:
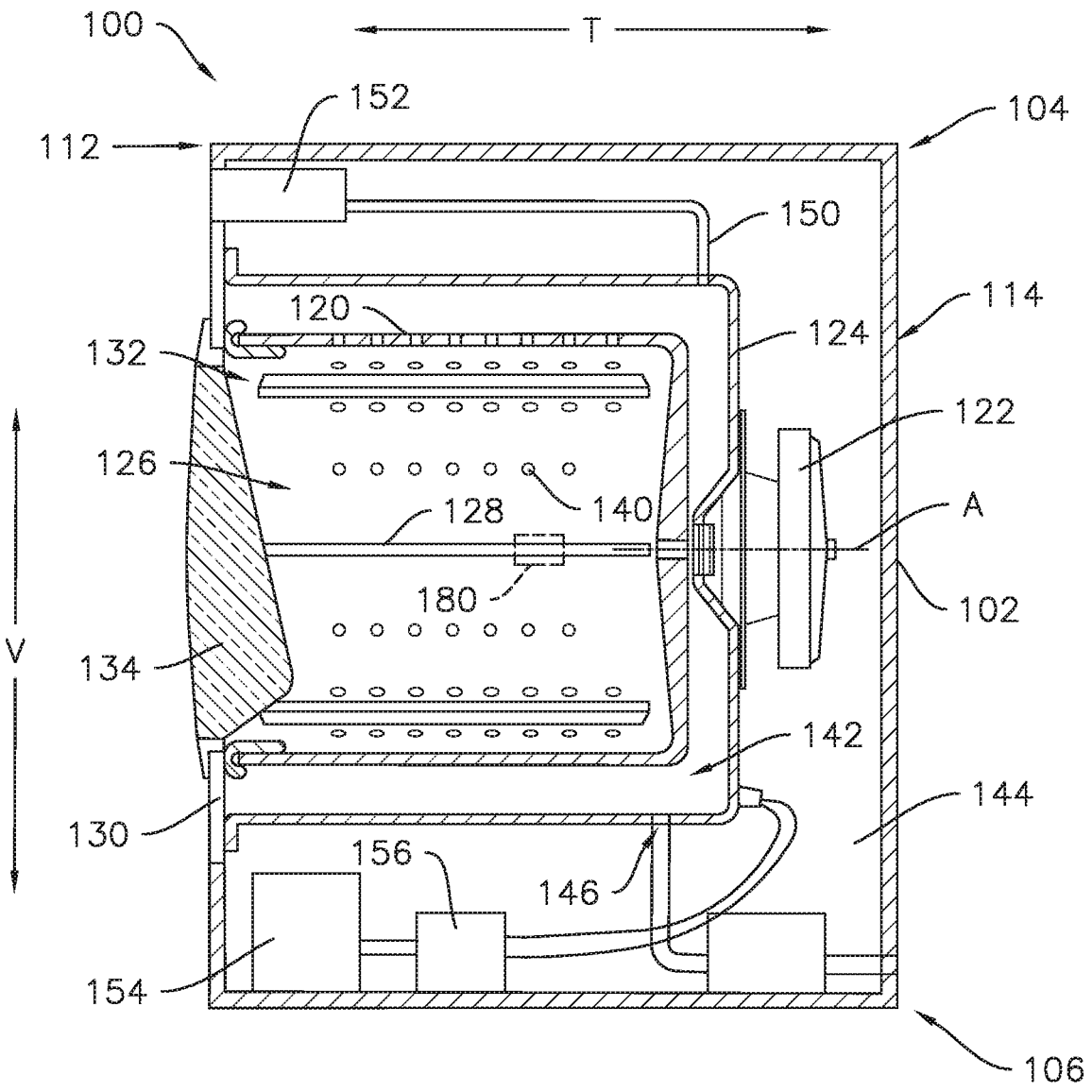
FIG. 2 provides a cross-sectional side view of the exemplary washing machine appliance.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash tub 124 is positioned within cabinet 102 and is generally configured for retaining wash fluids during an operating cycle. As used herein, "wash fluid" may refer to water, detergent, fabric softener, bleach, or any other suitable wash additive or combination thereof. Wash tub 124 is substantially fixed relative to cabinet 102 such that it does not rotate or translate relative to cabinet 102.

A wash basket 120 is received within wash tub 124 and defines a wash chamber 126 that is configured for receipt of articles for washing. More specifically, wash basket 120 is rotatably mounted within wash tub 124 such that it is rotatable about an axis of rotation A. According to the illustrated embodiment, the axis of rotation is substantially parallel to the transverse direction T. In this regard, washing machine appliance 100 is generally referred to as a "horizontal axis" or "front load" washing machine appliance 100. However, it should be appreciated that aspects of the present subject matter may be used within the context of a vertical axis or top load washing machine appliance as well.

Wash basket 120 may define one or more agitator features that extend into wash chamber 126 to assist in agitation and cleaning of articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Washing machine appliance 100 includes a motor assembly 122 that is in mechanical communication with wash basket 120 to selectively rotate wash basket 120 (e.g., during an agitation or a rinse cycle of washing machine appliance 100). According to the illustrated embodiment, motor assembly 122 is a pancake motor. However, it should be appreciated that any suitable type, size, or configuration of motor may be used to rotate wash basket 120 according to alternative embodiments. Motor assembly will be described in further detail below.

Referring generally to FIGS. 1 and 2, cabinet 102 also includes a front panel 130 that defines an opening 132 that permits user access to wash basket 120 of wash tub 124. More specifically, washing machine appliance 100 includes a door 134 that is positioned over opening 132 and is rotatably mounted to front panel 130 (e.g., about a door axis that is substantially parallel to the vertical direction V). In this manner, door 134 permits selective access to opening 132 by being movable between an open position (not shown) facilitating access to a wash tub 124 and a closed position (FIG. 1) prohibiting access to wash tub 124.

In some embodiments, a window 136 in door 134 permits viewing of wash basket 120 when door 134 is in the closed position (e.g., during operation of washing machine appliance 100). Door 134 also includes a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments. Additionally or alternatively, a front gasket or baffle 138 may extend between tub 124 and the front panel 130 about the opening 132 covered by door 134, further sealing tub 124 from cabinet 102.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of, and generally collects, wash fluid during operation of washing machine appliance 100. For example, during operation of washing machine appliance 100, wash fluid may be urged (e.g., by gravity) from basket 120 to sump 142 through plurality of perforations 140. A pump assembly 144 is located beneath wash tub 124 for gravity assisted flow when draining wash tub 124 (e.g., via a drain 146). Pump assembly 144 is also configured for recirculating wash fluid within wash tub 124.

Figure 3:
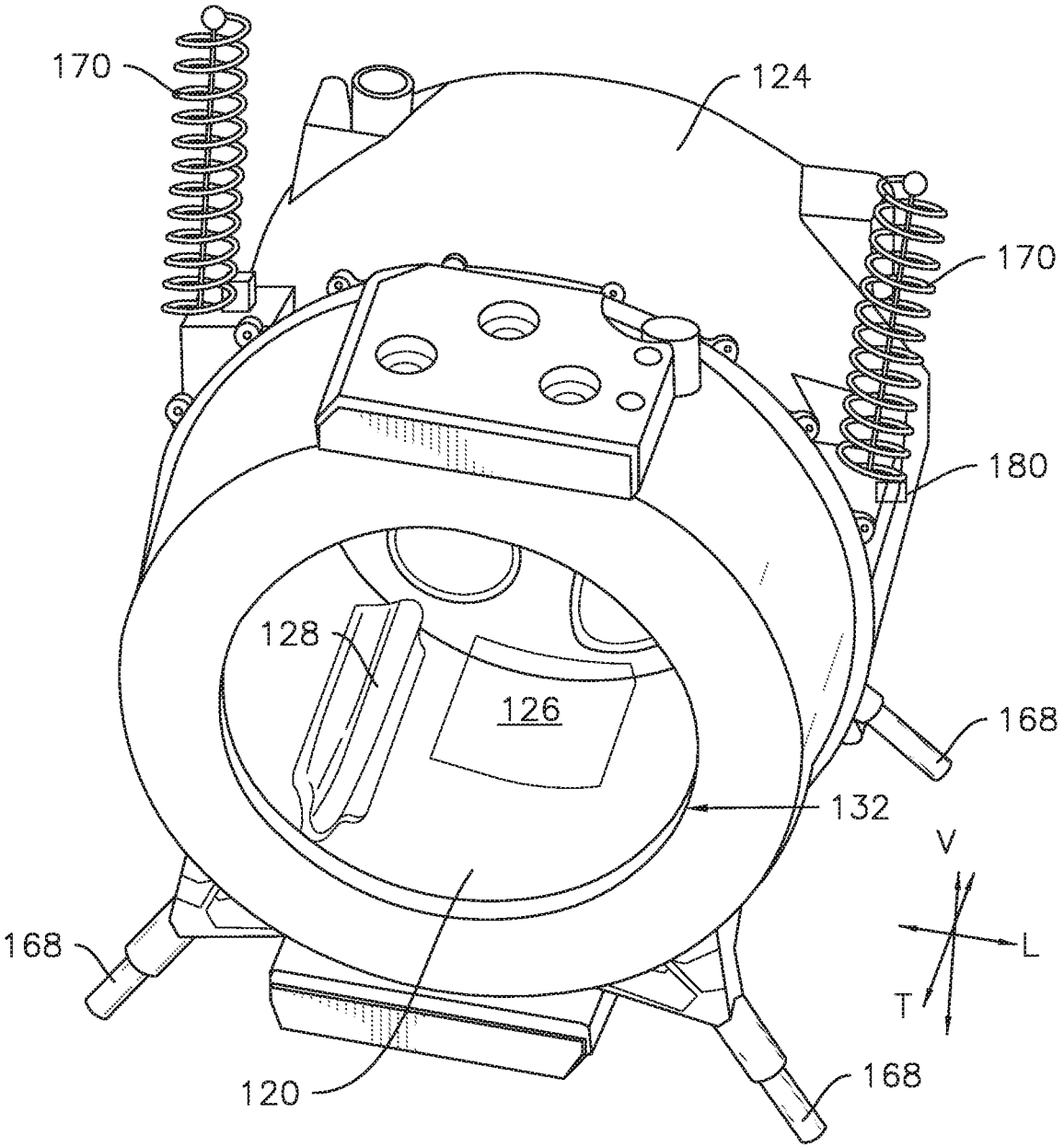
FIG. 3 provides a perspective view of a portion of the exemplary washing machine appliance, wherein the cabinet has been removed for clarity.
Figure 4:
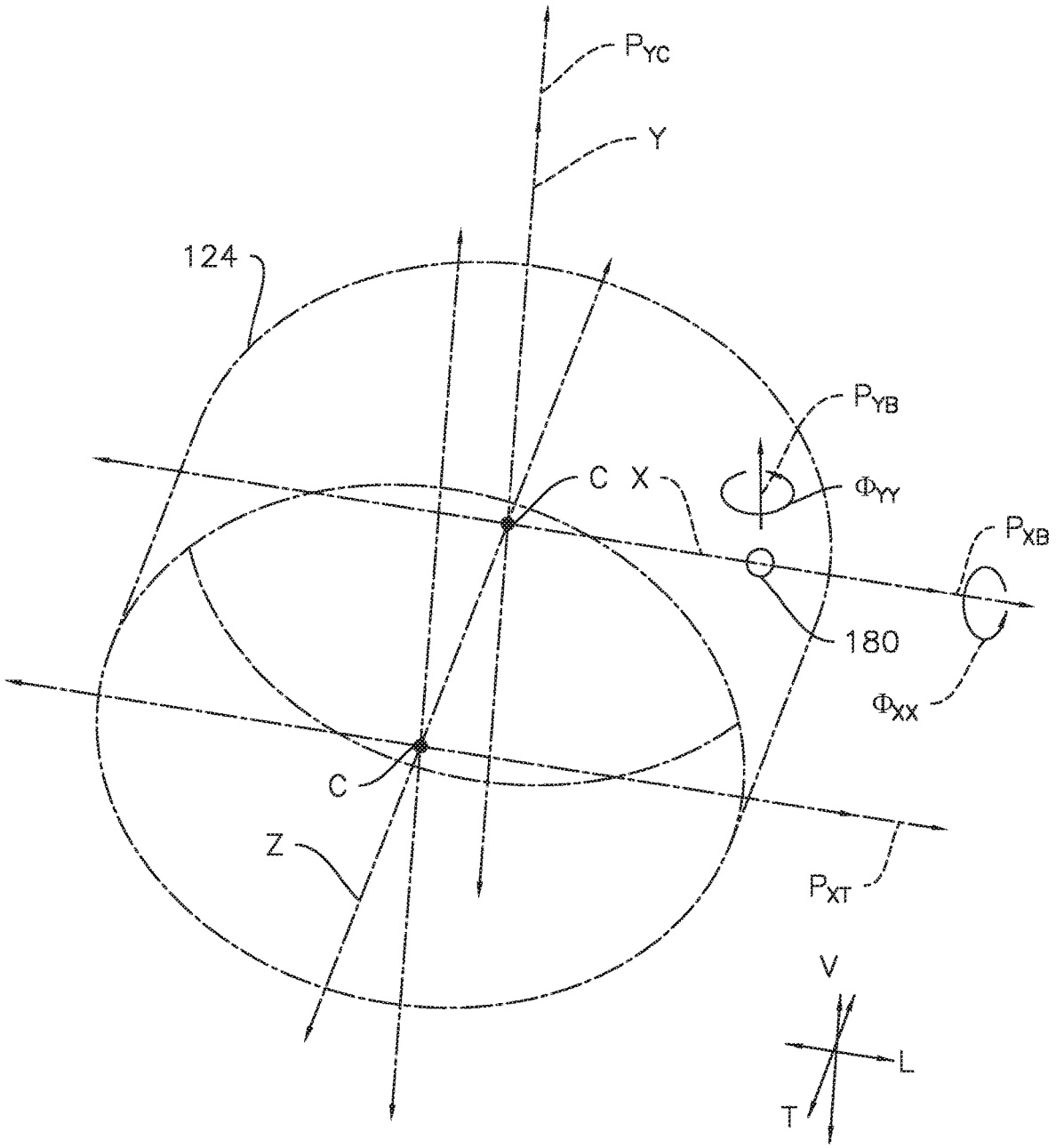
FIG. 4 provides a schematic perspective view of components of a washing machine appliance in accordance with exemplary embodiments of the present disclosure.
Figure 5:
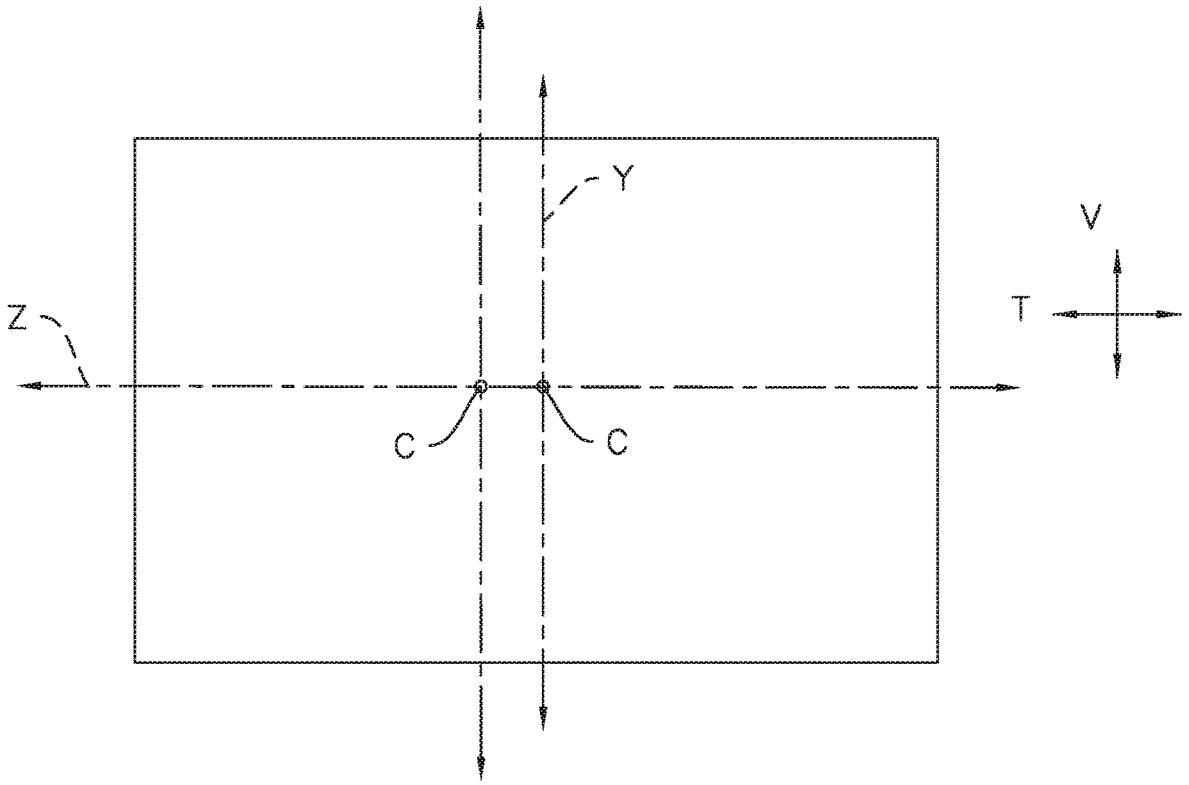
FIG. 5 provides a schematic side view of components of a washing machine appliance in accordance with exemplary embodiments of the present disclosure.
Figure 6:
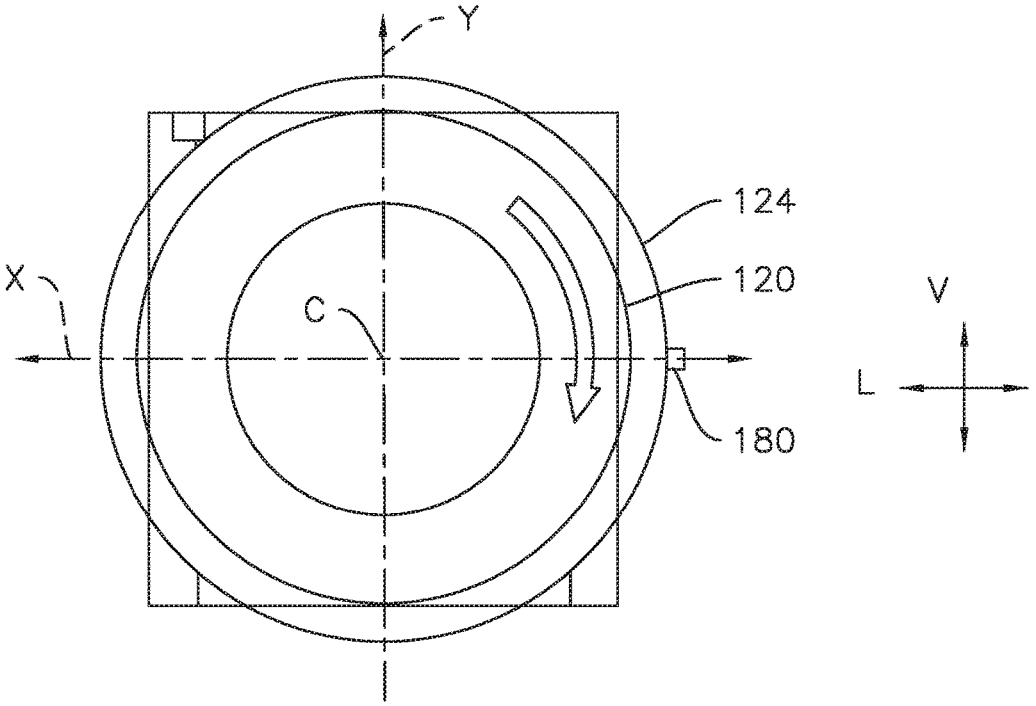
FIG. 6 provides a schematic front view of components of a washing machine appliance in accordance with exemplary embodiments of the present disclosure.

Turning briefly to FIG. 3, basket 120, tub 124, and machine drive system 148 are supported by a vibration damping system. The damping system generally operates to damp or reduce dynamic motion as the wash basket 120 rotates within the tub 124. The damping system can include one or more damper assemblies 168 coupled between and to the cabinet 102 and wash tub 124 (e.g., at a bottom portion of wash tub 124). Typically, four damper assemblies 168 are utilized, and are spaced apart about the wash tub 124. For example, each damper assembly 168 may be connected at one end proximate to a bottom corner of the cabinet 102. Additionally or alternatively, the washer can include other vibration damping elements, such as one or more suspension assemblies 170 positioned above basket 120 and attached to tub 124 at a top portion thereof. In optional embodiments, the vibration damping system (and washing machine appliance 100, generally) is free of any annular balancing rings, which would add an evenly-distributed rotating mass on basket 120. Thus, the rotating mass of the basket 120 may be relatively low, advantageously reducing the amount of energy or torque required to rotate basket 120.

Returning to FIGS. 1 and 2, in some embodiments, washing machine appliance 100 includes an additive dispenser or spout 150. For example, spout 150 may be in fluid communication with a water supply (not shown) in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

As illustrated, a detergent drawer 152 may be slidably mounted within front panel 130. Detergent drawer 152 receives a wash additive (e.g., detergent, fabric softener, bleach, or any other suitable liquid or powder) and directs the fluid additive to wash chamber 126 during operation of washing machine appliance 100. According to the illustrated embodiment, detergent drawer 152 may also be fluidly coupled to spout 150 to facilitate the complete and accurate dispensing of wash additive.

In optional embodiments, a bulk reservoir 154 is disposed within cabinet 102. Bulk reservoir 154 may be configured for receipt of fluid additive for use during operation of washing machine appliance 100. Moreover, bulk reservoir 154 may be sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from bulk reservoir 154 to wash tub 124.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, or other items of interest to machine users.

Operation of washing machine appliance 100 is controlled by a controller or processing device 166 that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive memory) and microprocessor, such as a general or special purpose microprocessor operable to execute programming instructions or micro-control code associated with a wash operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100, such as motor assembly 122 and measurement device 180 (discussed herein), may be in communication with controller 166 via one or more signal lines or shared communication busses. Optionally, measurement device 180 may be included with controller 166. Moreover, measurement devices 180 may include a microprocessor that performs the calculations specific to the measurement of motion with the calculation results being used by controller 166.

In exemplary embodiments, during operation of washing machine appliance 100, laundry items are loaded into wash basket 120 through opening 132, and a wash operation is initiated through operator manipulation of input selectors 162. For example, a wash cycle may be initiated such that wash tub 124 is filled with water, detergent, or other fluid additives (e.g., via additive dispenser 150). One or more valves (not shown) can be controlled by washing machine appliance 100 to provide for filling wash basket 120 to the appropriate level for the amount of articles being washed or rinsed. By way of example, once wash basket 120 is properly filled with fluid, the contents of wash basket 120 can be agitated (e.g., with ribs 128) for an agitation phase of laundry items in wash basket 120. During the agitation phase, the basket 120 may be motivated about the axis of rotation A at a set speed (e.g., first speed or tumble speed). As the basket 120 is rotated, articles within the basket 120 may be lifted and permitted to drop therein.

After the agitation phase of the washing operation is completed, wash tub 124 can be drained. Laundry articles can then be rinsed (e.g., through a rinse cycle) by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle or after the rinse cycle in order to wring wash fluid from the articles being washed. During a spin cycle, basket 120 is rotated at relatively high speeds. For instance, basket 120 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 120 increases its rotational velocity such that the plaster speed maintains the articles at a generally fixed position relative to basket 120.

After articles disposed in wash basket 120 are cleaned (or the washing operation otherwise ends), a user can remove the articles from wash basket 120 (e.g., by opening door 134 and reaching into wash basket 120 through opening 132).

Referring now to FIGS. 3 through 6, one or more measurement devices 180 may be provided in the washing machine appliance 100 for measuring movement of the tub 124, in particular during rotation of articles in the spin cycle of the washing operation. Measurement devices 180 may measure a variety of suitable variables that can be correlated to movement of the tub 124. The movement measured by such devices 180 can be utilized to monitor the load balance state of the tub 124 and to facilitate agitation in particular manners or for particular time periods to adjust the load balance state (i.e., as an attempt to balance articles within the basket 120).

A measurement device 180 in accordance with the present disclosure may include an accelerometer which measures translational motion, such as acceleration along one or more directions. Additionally or alternatively, a measurement device 180 may include a gyroscope, which measures rotational motion, such as rotational velocity about an axis. A measurement device 180 in accordance with the present disclosure is mounted to the tub 124 (e.g., on a sidewall of tub 124) to sense movement of the tub 124 relative to the cabinet 102 by measuring uniform periodic motion, non-uniform periodic motion, or excursions of the tub 124 during appliance 100 operation. For instance, movement may be measured as discrete identifiable components (e.g., in a predetermined direction).

In exemplary embodiments, a measurement device 180 may include at least one gyroscope or at least one accelerometer. The measurement device 180, for example, may be a printed circuit board that includes the gyroscope and accelerometer thereon. The measurement device 180 may be mounted to the tub 124 (e.g., via a suitable mechanical fastener, adhesive, etc.) and may be oriented such that the various sub-components (e.g., the gyroscope and accelerometer) are oriented to measure movement along or about particular directions as discussed herein. Notably, the gyroscope and accelerometer in exemplary embodiments are advantageously mounted to the tub 124 at a single location (e.g., the location of the printed circuit board or other component of the measurement device 180 on which the gyroscope and accelerometer are grouped). Such positioning at a single location advantageously reduces the costs and complexity (e.g., due to additional wiring, etc.) of out-of-balance detection, while still providing relatively accurate out-of-balance detection as discussed herein. Alternatively, however, the gyroscope and accelerometer need not be mounted at a single location. For example, a gyroscope located at one location on tub 124 can measure the rotation of an accelerometer located at a different location on tub 124, because rotation about a given axis is the same everywhere on a solid object such as tub 124.

As illustrated, tub 124 may define an X-axis, a Y-axis, and a Z-axis that are mutually orthogonal to each other. The Z-axis may extend along a longitudinal direction, and may thus be coaxial or parallel with the axis of rotation A (FIG. 2) when the tub 124 and basket 120 are balanced. Movement of the tub 124 measured by measurement device(s) 180 may, in exemplary embodiments, be measured (e.g., approximately measured) as a displacement amplitude or value.

In some embodiments, movement is measured as a plurality of unique displacements values. Optionally, the displacement values may occur in discrete channels of motion (e.g., as distinct directional components of movement). For instance, displacement values may correspond to one or more indirectly measured movement components perpendicular or approximately perpendicular to a center C (e.g., geometric center of gravity based on the shape and mass of tub 124 in isolation) of the tub 124. Such movement components may, for example, occur in a plane defined by the X-axis and Y-axis (i.e., the X-Y plane) or in a plane perpendicular to the X-Y plane. Movement of the tub 124 along the particular direction may be calculated using the indirect measurement component and other suitable variables, such as a horizontal or radial offset distance along the vector from the measurement device 180 to the center C of the tub 124. Additionally or alternatively, the displacement values may correspond to one or more directly measured movement components. Such movement components may, for example, occur in the X-Y plane or in a plane perpendicular to the X-Y plane.

The measured movement of the tub 124 in accordance with exemplary embodiments of the present disclosure, such as those requiring one or more gyroscopes and one or more accelerometers, may advantageously be calculated based on the movement components measured by the accelerometer or gyroscope of the measurement device(s) 180. For example, a movement component of the tub 124 may be a linear displacement vector $P_{XB}$ (e.g., a first displacement vector) of center C in the X-Y plane (e.g., along the lateral direction L). Displacement vector $P_{XB}$ may be calculated from detected movement by the accelerometer at measurement device 180 (e.g., via double integration of detected acceleration data). For example, vectors defined in an X-Y plane such as $P_{XB}$ may represent the radius of a substantially circular (e.g., elliptical, orbital, or perfectly circular) motion caused by the rotation of an imbalanced load so that maximum and minimum values of the periodic vector occur as the substantially circular motion aligns with the direction of the vector.

In additional or alternative embodiments, another movement component of tub 124 is obtained at measurement device 180. For instance, a wobble angle $\phi_{YY}$ of angular displacement of the tub 124 may be calculated. Wobble angle $\phi_{YY}$ may represent rotation relative to the axis of rotation A (FIG. 2) such as the angle of deviation of the Z-axis from its static or balanced position around the axis of rotation A. Wobble angle $\phi_{YY}$ may be calculated as a rotation parallel to the Y-axis using movement detected by the gyroscope at measurement device 180 (e.g., via integration of detected rotational velocity data).

In still further additional or alternative embodiments, a movement component of tub 124 may be a linear displacement vector $P_{XT}$ (e.g., a second displacement vector) of a center C' (e.g., effective center of gravity that compensates for biasing or resistance forces on tub 124 from one or more directions) in a plane parallel to the X-Y plane and perpendicular to the axis of rotation A (FIG. 2) (e.g., along the lateral direction L). Displacement vector $P_{XT}$ may thus be separated from the displacement vector $P_{XB}$ along the Z-axis. Optionally, the vector $P_{XT}$ may be calculated from movement detected at the accelerometer or gyroscope at measurement device 180. For example, displacement vector $P_{XT}$ may be calculated as a cross-product (e.g., the rotation at $\phi_{YY}$ times the transverse offset distance between measurement device 180 and C') added to another displacement vector (e.g., $P_{XB}$).

Notably, the term "approximately" as utilized with regard to the orientation and position of such movement measurements denotes ranges such as of plus or minus 2 inches or plus or minus 10 degrees relative to various axes passing through the basket center C which minimizes, for example, the contribution to error in the measurement result by rotation about the Z-axis, as might be caused, for example, by a torque reaction to motor assembly 122.

Further, and as discussed, the measurement device 180 need not be in the X-Y plane in which movement (e.g., at the center C) is calculated. For example, measurement device 180 may additionally be offset by an offset distance along the Z-axis. In one particular example, a measurement device 180 mounted to or proximate a suspension assembly 170 may be utilized to indirectly measure movement of the center C in an X-Y plane at or proximate the top of the tub 124. Additionally or alternatively, a measurement device 180 can be mounted close to or on the Z-axis or may be used to calculate motion that is not on the axis of rotation A (FIG. 2).

In some embodiments, an out-of-balance (OOB) value may be determined, at least in part, from the movement measured from measurement device 180. For instance, controller 166 may correlate displacement (e.g., as measured in inches) and rotational velocity (e.g., as measured at motor assembly 122 in rotations per minute) to an OOB value, such as a value of weight or mass (e.g., in pounds-mass). Advantageously, the determined OOB value may provide an accurate indicator of an imbalance that accounts for both displacement and rotation. In some such embodiments, a predetermined graph, table, or transfer function may be provided to determine a specific OOB value using a known or measured displacement value and rotational velocity. The predetermined graph, table, or transfer function may be determined from experimental data and, optionally, included within controller 166.

As an example, the OOB value may be determined from a transfer function provided as $$OOB=P_{XT}*(Q_1*V_R+Q_2)+(Q_3*V_R)-Q_4$$

wherein:

$P_{XT}$ is a measured displacement;

$V_R$ is a measured or otherwise known rotational velocity; and $Q_1$, $Q_2$, $Q_3$, and $Q_4$ are each unique predetermined coefficients relating to the corresponding washer appliance.

In optional embodiments, controller 166 may gather multiple OOB values (e.g., continuously or over a set period of time). From these multiple OOB values, controller 166 may determine a rate of change for the OOB values. For instance, controller 166 may calculate a rate of change across multiple OOB values spanning a sub-period of time. Additionally or alternatively, controller 166 may graph the OOB values and determine a slope of the graphed values at a specific point in time. Thus, in various embodiments, a relative displacement value or relative OOB value may be calculated based on one or both of the rate of change and/or the slope.

Figure 7:
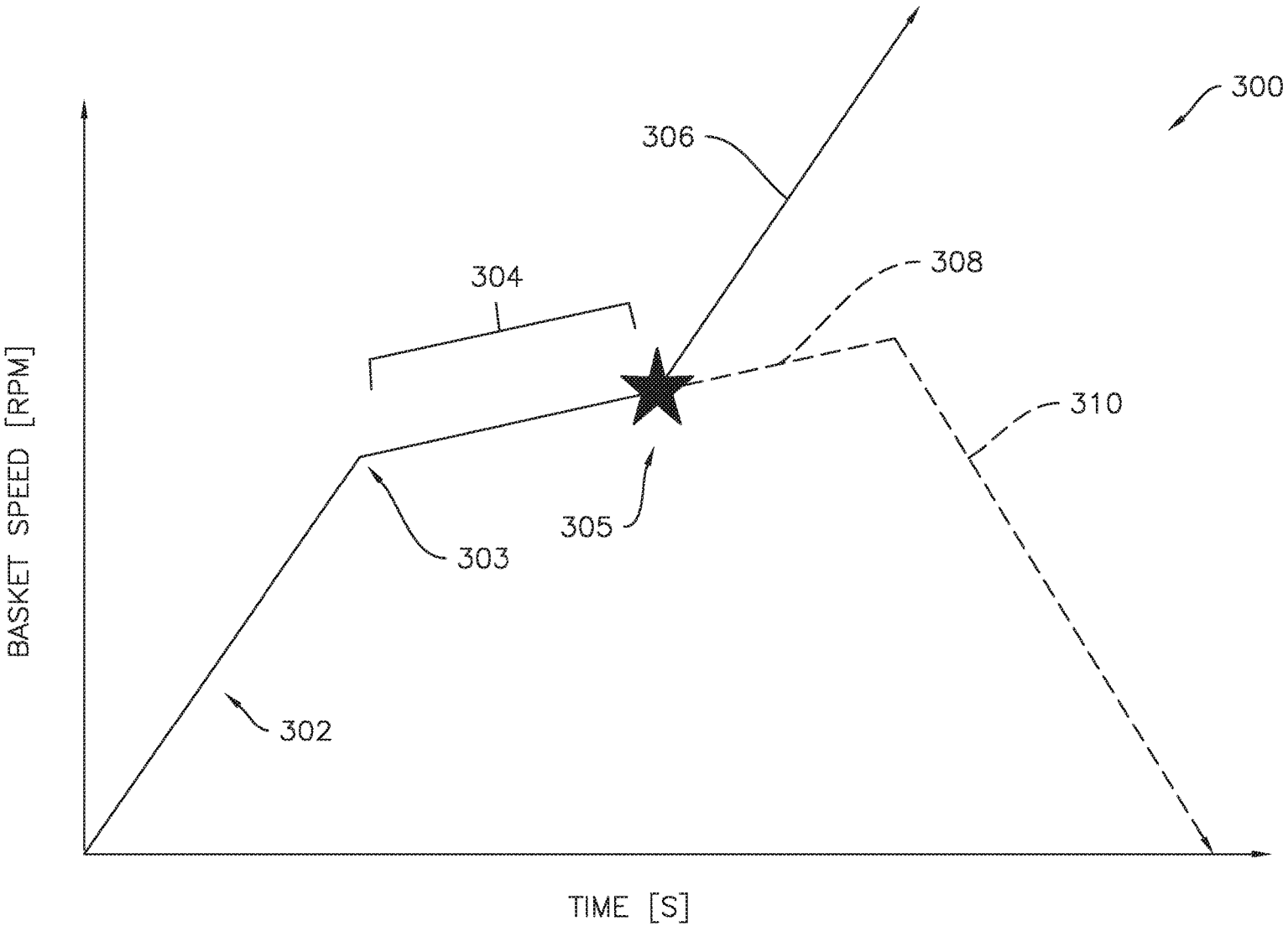
FIG. 7 provides a graph of rotational speed over time during an exemplary operation of a washing machine appliance according to one or more exemplary embodiments of the present disclosure.

FIG. 7 provides a graph 300 of rotational speed over time during an exemplary operation of a washing machine appliance. As shown in FIG. 7, the operation or cycle of the washing machine appliance may include a first period of time 302, during which the wash basket 120, including any articles therein, is rotated at a tumble speed. The speed of the wash basket 120 may increase over the first period of time until an inflection point 303 is reached. At the end of the first period of time 302, e.g., at the inflection point 303 as noted in FIG. 7, the wash basket 120 and articles therein may be rotated at a pre-plaster speed. The pre-plaster speed may be greater than the tumble speed. For example, in some embodiments, the point 303 may correspond to about 50 RPM, such that the tumble speed includes speeds from zero up to about 50 RPM. The pre-plaster speed may be between about 50 RPM and about 70 RPM. The wash basket 120 and articles therein may be rotated at the pre-plaster speed for a second period of time 304. During the second period of time, the OOB measurements may be taken and a plurality of OOB values may be determined and compared with various threshold, e.g., as will be described in more detail below in the context of exemplary methods illustrated in FIGS. 8 and 9. When the OOB values satisfy the applicable thresholds, e.g., at point 305 as noted in FIG. 7, the speed of the wash basket 120 may be increased from the pre-plaster speed to a plaster speed as shown at 306 in FIG. 7. Further as illustrated in FIG. 7, the pre-plaster speed during the second period of time 304 may not be a constant speed, rather, the rotation of the wash basket 120 may be continuously and gradually accelerated during the second period of time 304. In some instances, when the OOB values do not satisfy the applicable thresholds, the wash basket 120 and articles therein may continue to be rotated at the pre-plaster speed for a third period of time 308 after the second period of time 304. Further, if the OOB values continue to not meet the applicable criteria relative to the applicable thresholds (e.g., as will be described in more detail below in the context of exemplary methods illustrated in FIGS. 8 and 9) after the third period of time 308, the rotational velocity of the wash basket 120 may be reduced during a fourth period of time 310.

Figure 8:
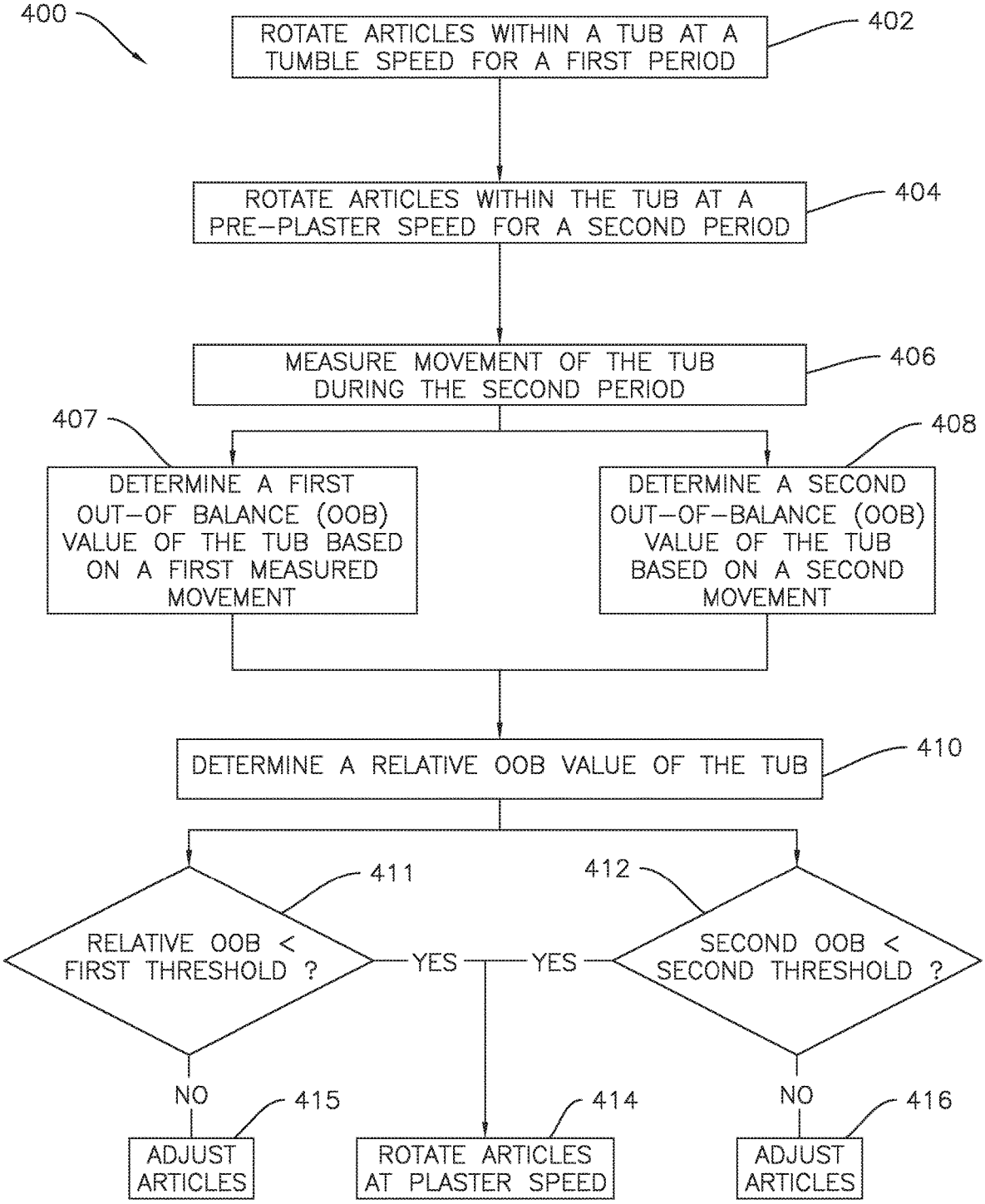
FIG. 8 provides a flow chart illustrating a method for operating a washing machine appliance in accordance with exemplary embodiments of the present disclosure.
Figure 9:
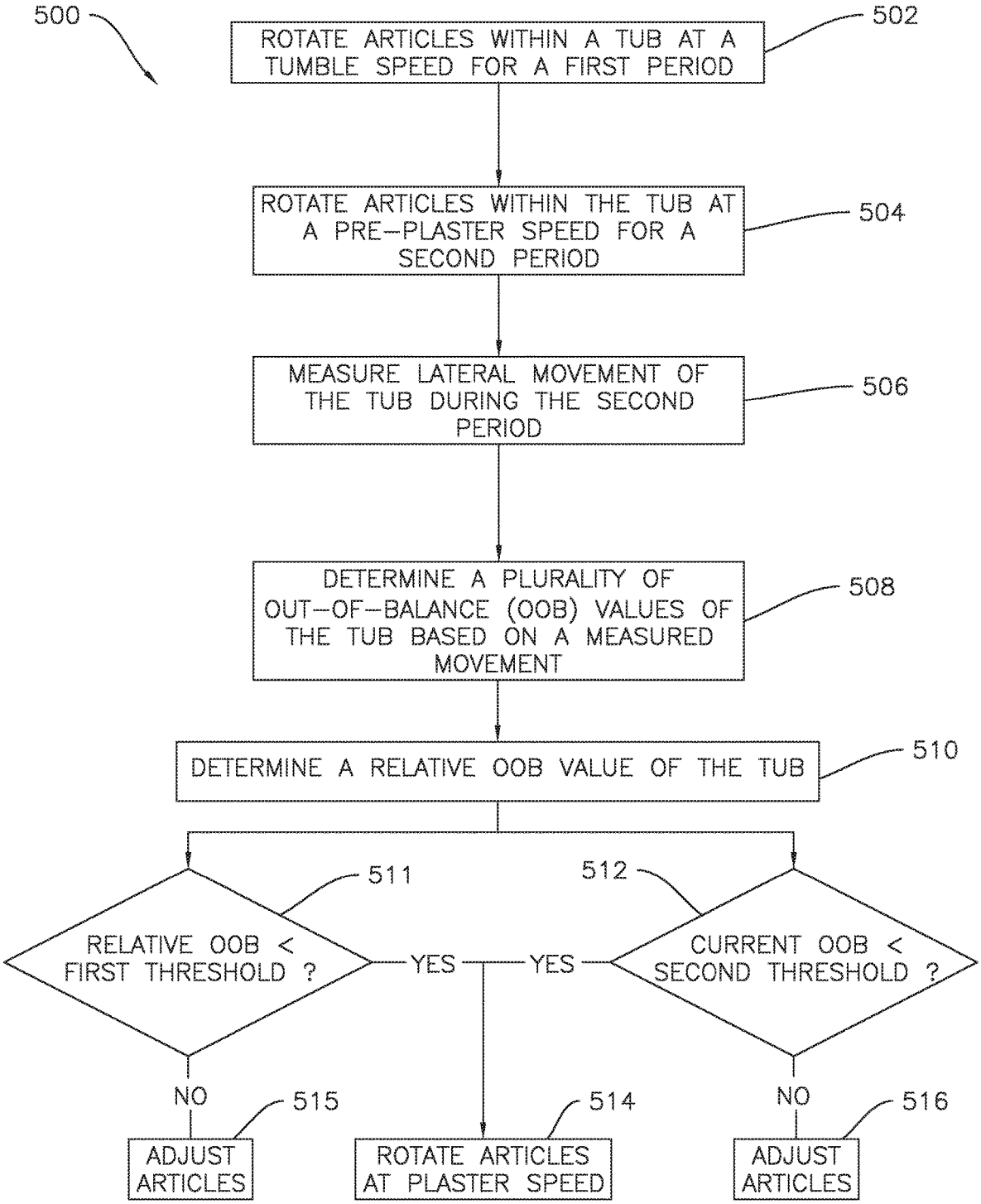
FIG. 9 provides a flow chart illustrating a method for operating a washing machine appliance in accordance with exemplary embodiments of the present disclosure.

Referring now to FIGS. 8 and 9, various methods may be provided for use with washing machine appliances in accordance with the present disclosure. In general, the various steps of methods as disclosed herein may, in exemplary embodiments, be performed by the controller 166, which may receive inputs and transmit outputs to and from various other components of the appliance 100. In particular, the present disclosure is further directed to methods, as indicated by reference numbers 400 and 500, for operating a washing machine appliance 100. Such methods advantageously facilitate monitoring of load balance states, detection of out-of-balance conditions, and reduction of out-of-balance conditions when detected. In exemplary embodiments, such balancing is performed during the spin cycle, following one or more of a draining, wash cycle, rinse cycle, etc.

Turning especially to FIG. 8, at 402, the method 400 includes rotating articles within the tub at a tumble speed for a first period. In certain embodiments, the first period is a defined period of time programmed into the controller. Optionally, the first period and the tumble speed (e.g., rotational velocity of basket or motor assembly) during the first period may be dependent upon the size of the load of articles and other variables that may, for example, be input by a user interacting with the control panel and input selectors thereof. In some embodiments, 402 follows a wash cycle or rinse cycle and may, furthermore, follow a draining a volume of liquid from the tub.

For instance, 402 may occur after flowing a volume of liquid into the tub. The liquid may include water, and may further include one or more additives as discussed above. The water may be flowed through hoses, a tube, and nozzle assembly into the tub and onto articles that are disposed in the basket for washing. The volume of liquid may be dependent upon the size of the load of articles and other variables which may, for example, be input by a user interacting with the control panel and input selectors thereof.

Optionally, 402 may occur after agitating articles within the tub (e.g., for an agitation period). During such agitation (which may be a sub-phase of the wash cycle), the volume of liquid flowed into the tub in may remain in the tub (i.e., before the volume of liquid is drained from tub). Moreover, during the agitation period, the basket may be rotated (e.g., at the tumble speed) or oscillated in alternating clockwise-counterclockwise rotation. The agitation period may be defined period of time programmed into the controller. The rotational or oscillation speed, pattern of agitation, and the agitation period may be dependent upon the size of the load of articles.

At 404, the method 400 includes rotating articles within the tub at a pre-plaster speed for a second period. Generally, the second period follows the first period (e.g., immediately or after one or more predefined periods or steps). Moreover, the second period may be a defined period of time programmed into the controller or an indeterminate period continued until a subsequent step is initiated. During the second period of 404, the basket may be rotated at the pre-plaster speed. The pre-plaster speed is greater than the tumble speed and is generally suitable to reduce the tumbling or agitation of articles within the tub, while still permitting some movement of the articles relative to, for example, the basket.

At 406, the method 400 includes measuring movement of the tub during the second period. In other words, 406 is performed simultaneously with at least a portion of the second period of 404 while articles continue to rotate at the pre-plaster speed. As described above, the measuring movement may include detecting movement of the tub as one or more displacement amplitudes or values using an accelerometer and a gyroscope. The displacement may be movement along the lateral direction (e.g., perpendicular to the axis of rotation). Additionally or alternatively, the measuring of movement may include measuring displacement at an effective center of gravity (e.g., for the tub or basket). The effective center of gravity is generally offset from a geometric center of gravity. For instance, the effective center of gravity may be offset along the Z-axis or transverse direction (e.g., parallel to the axis of rotation). The effective center of gravity may be a predetermined point calculated, for instance, from experimental data. Additionally or alternatively, the effective center may be the location (e.g., along the Z-axis) where the amplitude of $P_{XT}$ is approximately the same for any given out-of-balance mass located at any position along the transverse axis. Advantageously, the effective center of gravity may account for biasing forces or elements, such as the front baffle extending between the tub and the cabinet and biasing the tub along the Z-axis.

At 407, the method 400 includes determining a first out-of-balance (OOB) value (e.g., in units of weight or mass) of the tub based on a first measured movement. As described above, the OOB value may be calculated as a function of rotation velocity and, for example, measured displacement. Moreover, the function may be a predetermined transfer function. In some embodiments, a plurality of OOB values is calculated. For instance, unique OOB values may be calculated for unique displacement values measured at 406 (e.g., at different points in time during second period). Optionally, a rate of change across the plurality of values may be determined, e.g., a second OOB value may be determined at 408, and the second OOB value may be based on a second measured movement after the first measured movement. Thus, the rate of change may be determined as a relative OOB value of the tub at 410 and the relative OOB value may be based on the first OOB value and the second OOB value. Generally, multiple relative OOB values may be determined throughout the second period of 406, where each relative OOB value is based on a current OOB value and an immediately preceding OOB value.

At 411 and 412, the method 400 generally includes determining whether a first set condition and a second set condition are met based on the determined out-of-balance values. In some embodiments, the set condition includes threshold OOB values. The threshold OOB values may be set values (e.g., predetermined or programmed value), for instance, indicating an unsuitable imbalance condition. Thus, 411 may include comparing the determined relative OOB value to a first threshold OOB value and 412 may include comparing the current OOB value, e.g., second OOB value, to a second threshold. In some embodiments, if the determined relative OOB value is less than the first threshold OOB value and the determined second OOB value is less than the second threshold, the set conditions are met. The first threshold may be a threshold rate of change which may be a set value (e.g., predetermined or programmed value), for instance, indicating the balance of articles within the tub have reached a stable condition. The second threshold may be an absolute threshold, for instance, indicating that the magnitude of the movement of the tub is within acceptable limits.

If either (or both) of the set conditions is not met, the method 400 includes adjusting articles within the tub in response to the set condition not being met. For example, if the relative OOB value is not less than the first threshold at 411, the method 400 proceeds to adjust the articles at 415, and/or if the second OOB value is not less than the second threshold at 412, the method 400 proceeds to adjust the articles at 416. In some embodiments, the adjustment at 415 and/or 416 includes reducing the rotation velocity (e.g., of the basket). Optionally, the articles and basket may be returned to the pre-plaster speed (e.g., for a third period) or another reduced speed (e.g., the tumbling speed) such that articles within the tub may be permitted to move relative to, for example, the basket.

The third period generally follows the second time period (e.g., immediately or after one or more predefined periods or steps) and may be a defined period of time programmed into the controller or an indeterminate period continued until a subsequent step is initiated. Optionally, the movement may be measured during the third period (e.g., while the articles or basket rotate at the pre-plaster speed). Moreover, one or more additional OOB values may be determined from the third period measurement(s). From the additional OOB value(s), a new determination may be made if the set conditions are met. If the set conditions are both met, the method 400 may proceed to rotate the articles at a plaster speed greater than the pre-plaster speed at 414. If the set condition is not met, 415 and/or 416 may be repeated, rotation may be halted entirely, or another suitable adjustment may be made to address an imbalanced state within the tub.

At 414, the method 400 includes rotating articles within the tub at a plaster speed in response to determining the set conditions are both met (e.g., where the determinations at both 411 and 412 are YES). For instance, 414 may be performed over a fourth period that follows the second period (e.g., immediately or after one or more predefined periods or steps). The fourth period may be a defined period of time programmed into the controller or an indeterminate period continued until a subsequent step is initiated. Optionally, the fourth period and the plaster speed (e.g., rotational velocity of basket or motor assembly) during the fourth period may be dependent upon the size of the load of articles and other variables that may, for example, be input by a user interacting with the control panel and input selectors thereof. The plaster speed is greater than the pre-plaster speed and is generally suitable to plaster articles within the tub to the walls of the basket and encourage the shedding of water from the articles.

Turning now to FIG. 9, at 502, the method 500 includes rotating articles within the tub at a tumble speed for a first period. In certain embodiments, the first period is a defined period of time programmed into the controller. Optionally, the first period and the tumble speed (e.g., rotational velocity of basket or motor assembly) during the first period may be dependent upon the size of the load of articles and other variables that may, for example, be input by a user interacting with the control panel and input selectors thereof. In some embodiments, 502 follows a wash cycle or rinse cycle and may, furthermore, follow a draining a volume of liquid from the tub.

For instance, 502 may occur after flowing a volume of liquid into the tub. The liquid may include water, and may further include one or more additives as discussed above. The water may be flowed through hoses, a tube, and nozzle assembly into the tub and onto articles that are disposed in the basket for washing. The volume of liquid may be dependent upon the size of the load of articles and other variables which may, for example, be input by a user interacting with the control panel and input selectors thereof.

Optionally, 502 may occur after agitating articles within the tub (e.g., for an agitation period). During such agitation (which may be a sub-phase of the wash cycle), the volume of liquid flowed into the tub in may remain in the tub (i.e., before the volume of liquid is drained from tub). Moreover, during the agitation period, the basket may be rotated (e.g., at the tumble speed) or oscillated in alternating clockwise-counterclockwise rotation. The agitation period may be defined period of time programmed into the controller. The rotational or oscillation speed, pattern of agitation, and the agitation period may be dependent upon the size of the load of articles.

At 504, the method 500 includes rotating articles within the tub at a pre-plaster speed for a second period. Generally, the second period follows the first period (e.g., immediately or after one or more predefined periods or steps). Moreover, the second period may be a defined period of time programmed into the controller or an indeterminate period continued until a subsequent step is initiated. During the second period of 504, the basket may be rotated at the pre-plaster speed. The pre-plaster speed is greater than the tumble speed and is generally suitable to reduce the tumbling or agitation of articles within the tub, while still permitting some movement relative to, for example, the basket.

At 506, the method 500 includes measuring movement of the tub along the lateral direction (e.g., perpendicular to the axis of rotation) during the second period. In other words, 506 is performed simultaneously with at least a portion of the second period of 504 while articles continue to rotate at the pre-plaster speed. As described above, the measuring movement may include detecting movement of the tub as one or more displacement amplitudes or values using the accelerometer and a gyroscope. The displacement may be movement along the lateral direction (e.g., perpendicular to the axis of rotation). Additionally or alternatively, the measuring of movement may include measuring displacement at an effective center of gravity (e.g., for the tub or basket). The effective center of gravity is generally offset from a geometric center of gravity. For instance, the effective center of gravity may be offset along the Z-axis or transverse direction (e.g., parallel to the axis of rotation). The effective center of gravity may be a predetermined point calculated, for instance, from experimental data. Additionally or alternatively, the effective center may be the location (e.g., along the Z-axis) where the amplitude of $P_{XT}$ is approximately the same for any given out-of-balance mass located at any position along the transverse axis. Advantageously, the effective center of gravity may account for biasing elements, such as the front baffle extending between the tub and the cabinet.

The method 500 may include determining a plurality of out-of-balance (OOB) values of the tub based on the measured movement, as described above. For example, the OOB value may be calculated as a function of rotation velocity and, for example, measured displacement.

Using the plurality of OOB values, e.g., based on chronologically consecutive OOB values such as a current out-of-balance value and a previous out-of-balance value of the plurality of out-of-balance values, a relative OOB value of the tub may be determined at 510.

At 511 and 512, the method 500 generally includes determining whether a first set condition and a second set condition are met based on the measured movement. For instance, the set conditions may include threshold displacement values. In other words, the set conditions may require that the measured lateral displacement be less than the threshold displacement value. In additional or alternative embodiments, the set conditions include threshold OOB values. As described above, the threshold OOB values may be a set value (e.g., predetermined or programmed value), for instance, indicating an unsuitable imbalance condition.

Thus, 511 may include comparing the determined relative OOB value to a first threshold OOB value and 512 may include comparing the current OOB value to a second threshold OOB value. For example, the first threshold OOB value may be a relative or rate of change OOB value and the second threshold OOB value may be an absolute magnitude value. In some embodiments, the first threshold OOB value includes a threshold rate of change across the plurality of determined OOB values, e.g., from the previous (immediately preceding) OOB value to the current OOB value. The threshold rate of change may be a set value (e.g., predetermined or programmed value), for instance, indicating the balance of articles within the tub have reached a stable condition. Thus, 511 may include comparing the determined rate of change to the threshold rate of change. If the determined relative OOB value is less than the first threshold OOB value and the determined current OOB value is less than the second threshold OOB value, the set conditions may be met.

At 515 and 516, the method 500 includes adjusting articles within the tub in response to either or both of the set conditions not being met. In some embodiments, the adjustment at 515 or 516 includes reducing the rotation velocity (e.g., of the basket). Optionally, the articles and basket may be returned to the pre-plaster speed (e.g., for a third period) or another reduced speed (e.g., the tumbling speed) such that articles within the tub may be permitted to move relative to, for example, the basket.

The third period generally follows the second time period (e.g., immediately or after one or more predefined periods or steps) and may be a defined period of time programmed into the controller or an indeterminate period continued until a subsequent step is initiated. Optionally, the movement may be measured during the third period (e.g., while the articles or basket rotate at the pre-plaster speed). Moreover, one or more additional OOB values may be determined from the third period measurement(s). From the additional OOB value(s), a new determination may be made if the set condition is met. If the set condition is met, the method 500 may proceed to 514. If either the set condition is not met at 511 or 512, 515 or 516 may be repeated, rotation may be halted entirely, or another suitable adjustment may be made to address an imbalanced state within the tub.

At 514, the method 500 includes rotating articles within the tub at a plaster speed in response to determining the set condition is met (e.g., where the relative out-of-balance value is less than the first threshold at 511 and the current out-of-balance value is less than the second threshold at 512). For instance, 514 may be performed over a fourth period that follows the second period (e.g., immediately or after one or more predefined periods or steps). The fourth period may be a defined period of time programmed into the controller or an indeterminate period continued until a subsequent step is initiated. Optionally, the fourth period and the plaster speed (e.g., rotational velocity of basket or motor assembly) during the fourth period may be dependent upon the size of the load of articles and other variables that may, for example, be input by a user interacting with the control panel and input selectors thereof. The plaster speed is greater than the pre-plaster speed and is generally suitable to plaster articles within the tub to the walls of the basket and encourage the shedding of water from the articles.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the washing machine appliance having a tub, the method comprising:

rotating articles within the tub at a tumble speed for a first period;

rotating articles within the tub at a pre-plaster speed for a second period following the first period, the pre-plaster speed being greater than the tumble speed;

measuring movement of the tub during the second period;

determining a first out-of-balance value of the tub based on a first measured movement;

determining a second out-of-balance value of the tub based on a second measured movement after the first measured movement;

determining a relative out-of-balance value of the tub based on the first out-of-balance value and the second out-of-balance value;

determining whether the relative out-of-balance value is less than a first threshold and whether the second out-of-balance value is less than a second threshold; and rotating articles within the tub at a plaster speed greater than the pre-plaster speed in response to determining the relative out-of-balance value is less than the first threshold and the second out-of-balance value is less than the second threshold.

2. The method of claim 1, wherein rotating articles within the tub at the pre-plaster speed during the second period comprises rotating articles within the tub at a first pre-plaster speed and a second pre-plaster speed greater than the first pre-plaster speed.

3. The method of claim 2, wherein rotating articles within the tub at the pre-plaster speed during the second period comprises rotating articles within the tub at the first pre-plaster speed immediately after the first period, followed by continuously and gradually accelerating from the first pre-plaster speed to the second pre-plaster speed.

4. The method of claim 1, wherein the measured movement is movement along a lateral direction.

5. The method of claim 4, wherein the measured movement is movement perpendicular to an axis of rotation within the tub.

6. The method of claim 1, wherein determining the first out-of-balance value comprises calculating the first out-of-balance value as a function of a rotational velocity within the washing machine appliance.

7. The method of claim 1, wherein measuring movement comprises measuring displacement at an effective center of gravity, wherein the effective center of gravity is offset from a geometric center of gravity along a transverse direction.

8. The method of claim 7, wherein the transverse direction is parallel to an axis of rotation within the tub.

9. The method of claim 1, further comprising reducing rotational velocity in response to determining the relative out-of-balance value is not less than the first threshold or the second out-of-balance value is not less than the second threshold.

10. The method of claim 1, further comprising rotating articles within the tub at the pre-plaster speed for a third period in response to determining the relative out-of-balance value is not less than the first threshold or the second out-of-balance value is not less than the second threshold.

11. A method for operating a washing machine appliance, the washing machine appliance defining a mutually-orthogonal vertical direction, transverse direction, and lateral direction, the washing machine appliance having a tub within which an axis of rotation is defined, the method comprising:

rotating articles within the tub at a tumble speed for a first period;

rotating articles within the tub at a pre-plaster speed for a second period following the first period, the pre-plaster speed being greater than the tumble speed;

measuring movement of the tub along the lateral direction during the second period, the lateral direction being perpendicular to the axis of rotation;

determining a plurality of out-of-balance values of the tub based on the measured movement, the plurality of out-of-balance values comprising a current out-of-balance value and a previous out-of-balance value;

determining a relative out-of-balance value of the tub based on the plurality of out-of-balance values;

determining whether the relative out-of-balance value is less than a first threshold and whether the current out-of-balance value is less than a second threshold; and rotating articles within the tub at a plaster speed greater than the pre-plaster speed in response to determining the relative out-of-balance value is less than the first threshold and the current out-of-balance value is less than the second threshold.

12. The method of claim 11, wherein rotating articles within the tub at the pre-plaster speed during the second period comprises rotating articles within the tub at a first pre-plaster speed and a second pre-plaster speed greater than the first pre-plaster speed.

13. The method of claim 12, wherein rotating articles within the tub at the pre-plaster speed during the second period comprises rotating articles within the tub at the first pre-plaster speed immediately after the first period, followed by continuously and gradually accelerating from the first pre-plaster speed to the second pre-plaster speed.

14. The method of claim 11, wherein determining the plurality of out-of-balance values comprises calculating each value of the plurality of out-of-balance values as a function of a rotational velocity within the washing machine appliance.

15. The method of claim 11, wherein measuring movement comprises measuring displacement at an effective center of gravity, wherein the effective center of gravity is offset from a geometric center of gravity along the transverse direction.

16. The method of claim 11, wherein the transverse direction is parallel to an axis of rotation within the tub.

17. The method of claim 11, further comprising reducing rotational velocity in response to determining the relative out-of-balance value is not less than the first threshold or the current out-of-balance value is not less than the second threshold.

18. The method of claim 11, further comprising rotating articles within the tub at the pre-plaster speed for a third period in response to determining the relative out-of-balance value is not less than the first threshold or the current out-of-balance value is not less than the second threshold.

* * * * *